US005401439A

United States Patent [19]

Elfers et al.

[11] Patent Number: 5,401,439

[45] Date of Patent: Mar. 28, 1995

[54] OIL-DEMULSIFIERS BASED ON AN ALKOXYLATE AND PREPARATION OF THIS ALKOXYLATE

[75] Inventors: Guenther Elfers, Birkenau; Wilfried Sager, Mutterstadt; Hans-Henning Vogel, Frankenthal; Knut Oppenlaender, Ludwigshafen, all of Germany

[73] Assignee: BASF Aktiengesellschaft, Ludwigshafen, Germany

[21] Appl. No.: 994,260

[22] Filed: Dec. 21, 1992

[30] Foreign Application Priority Data

Dec. 21, 1991 [DE] Germany ..... 41 42 579.0

[51] Int. Cl.[6] ..... B01D 17/04; B01D 17/05

[52] U.S. Cl. ..... 252/358; 210/708; 252/331; 252/340; 252/344; 568/619

[58] Field of Search ..... 252/331, 344, 358, 340; 210/708; 568/619

[56] References Cited

U.S. PATENT DOCUMENTS

| | | | |
|---|---|---|---|
| 2,278,838 | 4/1942 | De Groote et al. | 252/8.553 |
| 2,615,853 | 10/1952 | Kirkpatrick et al. | 252/331 |
| 2,754,271 | 7/1956 | Kirkpatrick | 252/331 |
| 2,885,367 | 5/1959 | Case | 252/331 X |
| 3,617,571 | 11/1971 | Mange et al. | 252/358 X |
| 3,907,701 | 9/1975 | Liebold et al. | 252/344 |
| 4,032,514 | 6/1977 | Buriks et al. | 252/331 X |
| 4,419,265 | 12/1983 | Diery et al. | 252/331 |
| 4,431,565 | 2/1984 | Billenstein et al. | 252/331 |
| 4,465,817 | 8/1984 | Billenstein et al. | 525/507 |
| 4,537,701 | 8/1985 | Oppenlaender et al. | 252/344 |
| 4,551,239 | 11/1985 | Merchant et al. | 208/188 |
| 4,588,508 | 5/1986 | Allenson et al. | 210/708 |
| 4,705,.834 | 11/1987 | Baur et al. | 525/540 |
| 4,737,265 | 4/1988 | Merchant, Jr. et al. | 210/708 X |
| 4,814,394 | 3/1989 | Barthold et al. | 525/405 |

FOREIGN PATENT DOCUMENTS

| | | | |
|---|---|---|---|
| 055434 | 7/1982 | European Pat. Off. . | |
| 097897 | 1/1984 | European Pat. Off. . | |
| 147743 | 7/1985 | European Pat. Off. . | |
| 174399 | 3/1986 | European Pat. Off. . | |
| 246582 | 11/1987 | European Pat. Off. . | |
| 2435713 | 2/1976 | Germany . | |
| 2719978 | 9/1980 | Germany . | |
| 50-12479 | 12/1975 | Japan | 568/619 |

*Primary Examiner*—Richard D. Lovering
*Attorney, Agent, or Firm*—Keil & Weinkauf

[57] ABSTRACT

Oil demulsifiers are based on an alkoxylate having a polydispersity of at least 1.7, and the alkoxylates are prepared using a metal alcoholate as a catalyst.

10 Claims, No Drawings

OIL-DEMULSIFIERS BASED ON AN ALKOXYLATE AND PREPARATION OF THIS ALKOXYLATE

The present invention relates to oil demulsifiers, containing an alkoxylate of an alkylphenol/formaldehyde resin, of an alcohol, of a bisphenol or of an amine, and to a process for the preparation of the alkoxylates using a special catalyst.

In the production of crude oils, an increasing amount of water is simultaneously extracted with increasing exploitation of the deposits. Surfactants present in the crude oils emulsify the major part of the water, stable water-in-oil emulsions being formed. The emulsified water may account for from 0.1 to more than 50% by weight of the total emulsion. Salts which lead to corrosion problems in the further processing of the crude oil in the refinery may be dissolved in the emulsion water. Before transport, the emulsion water must therefore be separated off or reduced to below an acceptable concentration. This is generally done by adding oil demulsifiers, separation being facilitated and accelerated by heating the crude oil.

The crude oils differ greatly in their composition depending on their origin. The natural emulsifiers present in the crude oils furthermore have a complicated chemical structure, so that oil demulsifiers must be developed selectively to overcome their effect. Owing to the opening up of new oil fields and changed production conditions in old fields, there is a constant need for novel demulsifiers which result in more rapid separation into water and oil and very small amounts of residual water and residual salts.

The most frequently used demulsifiers are ethylene oxide/propylene oxide block copolymers, alkoxylated alkylphenol/formaldehyde resins, as described in, for example, German Patent 2,719,978, alkoxylated polyamines (cf. for example U.S. Pat. No. 3,907,701 and German Laid-Open Application DOS 2,435,713) and crosslinking products of the above basic classes with polyfunctional reagents, for example diisocyanates, dicarboxylic acids, bisglycidyl ethers and di- and trimethylolphenols.

However, the known oil demulsifiers frequently do not fully meet the requirements since separation of the emulsion into on-spec oil and water having a very small residual oil content either takes too long or requires excessively large doses of the demulsifier.

It is an object of the present invention to provide oil demulsifiers which permit highly quantitative separation of the emulsion into oil and water in a very short time, ie. which exhibit good efficiency even in a small dose.

Since, for economic and ecological reasons, very substantial exploitation of the oil fields and complete separation of the residual oil from the water are becoming increasingly important, the achievement of this object is of additional importance.

We have found that this object is achieved by oil demulsifiers based on an alkoxylate of the general formula I $$R[(A-O)_n H]_p \qquad \text{I}$$

where A is ethylene, propylene and/or butylene, n is 3-100 and R is the radical of an alkylphenol/formaldehyde resin of the formula II

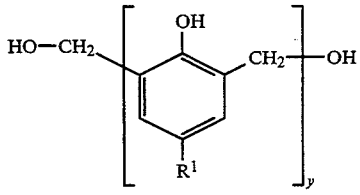

II where $R^1$ is branched $C_3$–$C_{18}$-alkyl and y is from 3 to 30, of an alcohol of the formula III $$(R^3O)_z R^2 (OH)_x \qquad \text{III}$$

where either $R^2$ is $C_1$–$C_{20}$-alkyl, x is 1 and z is 0 or $R^2$ is $C_2$–$C_{10}$-alkylene, x is 2 and z is 0 or x is 1, z is 1 and $R^3$ is $C_1$–$C_6$-alkyl or $C_1$–$C_{20}$-acyl, or $R^2$ is $C_6$–$C_{10}$-aryl which may be substituted by up to 2 $C_3$–$C_{18}$-alkyl radicals, x is 1 and z is 0, of an amine of the formula IV $$R^4-NH_2 \qquad \text{IV}$$

where $R^4$ is a straight-chain or branched $C_1$–$C_6$-alkyl or $C_1$–$C_{10}$-hydroxyalkyl radical or is a radical of the following formula V $$(CH_2)_m \underset{\underset{R^5}{|}}{N} (CH_2)_r - NH_2 \qquad \text{V}$$

where $R^5$ is H or $C_1$–$C_3$-alkyl, m is from 2 to 4, r is from 2 to 10 and q is from 0 to 5, of a bisphenol of the formula VI

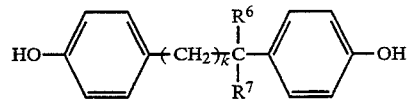

VI where k may be from 0 to 3 and $R^6$ and $R^7$ independently of one another may each be H or $C_1$–$C_3$-alkyl, or of a polyethyleneimine having a molecular weight $\overline{M}_w$ of from 2,000 to 50,000, where the $[H-(O-A)]$-radicals are each present in place of those hydrogens of the alkylphenol/formaldehyde resins, alcohols, bisphenols, amines or polyethyleneimines which are on the oxygen or nitrogen and p is the number of hydrogens to be alkoxylated, wherein the alkoxylate of the formula I has a polydispersity $Q=\overline{M}_w/\overline{M}_n$ of at least 1.7.

It is essential for the desired properties of the novel oil demulsifiers that the alkoxylate has the stated polydispersity. This polydispersity is achieved by preparing the alkoxylate using a special catalyst.

The present invention therefore also relates to a process for the preparation of alkoxylates of the above general formula I, wherein an alkylphenol/formaldehyde resin of the abovementioned formula II, a bisphenol of the abovementioned formula VI, an alcohol of the abovementioned formula III, an amine of the abovementioned formula IV or a polyethyleneimine having a molecular weight $\overline{m}_w$ of from 2,000 to 50,000 is reacted with ethylene oxide, propylene oxide and/or butylene oxide in the presence of an unhydrolyzed or partly hydrolyzed metal alcoholate as a catalyst, the metal being selected from the metals of groups IIA, IIIA and IVB and Zn, Ce and La and the alcoholate group being of 1 to 8 carbon atoms.

In the case of the prior art oil demulsifiers based on alkoxylated compounds, hydroxides of the alkali metals are used as catalysts for the alkoxylation (cf. for example German Patent 2,013,820, column 5, AII). As found in comparative experiments, only polydispersities of up to 1.6 are achieved with these catalysts.

We have found,, surprisingly, that, using the novel oil demulsifiers, substantially more rapid demulsification of the crude oil emulsions is achieved or the novel demulsifiers can be metered in a correspondingly smaller amount.

The polydispersity $Q=\overline{M}_w/\overline{M}_n$ is known to be a measure of the molecular weight distribution of polymeric compounds (cf. for example Encyclopedia of Polymer Sci. and Engineering, Vol. 10, page 4, J. Wiley 1987). The larger the value of Q, the broader is the molecular weight distribution. For the alkoxylate prepared according to the invention, this means that they have a broader molecular weight distribution than the known compounds prepared using an alkali metal hydroxide as a catalyst.

For the alkylphenol/formaldehyde resins, this can also be expressed in terms of the hydroxyl number: while the known alkoxylates have hydroxyl numbers of from 130 to 170, the alkoxylates prepared according to the invention have hydroxyl numbers of more than 170, preferably from 180 to 300.

Alkylphenol/formaldehyde resins of the formula II, alcohols of the formula III, amines of the formula IV, bisphenols of the formula VI or polyethyleneimines having a molecular weight $\overline{M}_w$ of from 2,000 to 50,000, in particular from 5,000 to 25,000, are used as starting compounds for the preparation of the alkoxylates.

Alkylphenol/formaldehyde resins, alcohols and polyethyleneimines are preferred.

Alkylphenol/formaldehyde resins which may be prepared by known processes and are used in particular are those which carry an iso-$C_4$-$C_{12}$-alkyl radical and in which y is from 5 to 11. An iso-$C_8$-$C_{12}$-alkyl radical is particularly preferred.

Alcohols which are used in particular are diols, eg. ethylene glycol, diethylene glycol or butylene glycol, or glycol monoesters, eg. ethylene glycol monoacetate.

Amines to be used are in particular the polyalkylenepolyamines, eg. diethylenetriamine, triethylenetetramine or tetraethylenepentamine. Alkanolamines are also suitable.

The polyethyleneimines are preferably branched and contain primary, secondary and tertiary amino groups.

A particular example of a hisphenol is bisphenol A.

All these compounds are known per se and are described widely in the literature.

The alkoxylation of the alkylphenol/formaldehyde resins, alcohols, bisphenols, amines and polyethyleneimines is carried out with ethylene oxide, propylene oxide and/or butylene oxide. Ethylene oxide and/or propylene oxide are preferably used.

The reaction is carried out in an inert solvent, eg. toluene or xylene, usually at from 100° to 180° C. The required number of moles of alkylene oxide per unit to be oxyalkylated or OH or $H_2N$ group are passed in, so that n is 3–100, preferably 3–50, particularly preferably 4–12. In the case of the amines, the 2-stage reaction as described in, for example, German Laid-Open Application DOS 2,435,713 is advantageous. The amount of starting compound and alkylene oxide in relation to the solvent is chosen, for example, so that an 80% strength by weight solution results.

The catalysts used are the novel metal alcoholates which can be represented by the following formula VII $$Me(OH)_d(OR)_e \qquad \text{VII}$$

where Me is a metal of the group IIA, in particular Mg, Ca or Ba, of group IIIA, in particular Al or of group IVB, in particular Ti (groups defined according to CAS up to 1986), or Zn, Ce or La, d may be 0 and the upper limits of d and e depend on the valency of the metal. Aluminum trialcoholates or titanium tetraalcoholates, in particular aluminum triisopropylate, are preferred.

The metal alcoholates are also used in conjunction with Zn alkyls and small amounts of $H_2O$ in hexane (cf. U.S. Pat. No. 3,384,603).

The amount of catalyst used is from 0.05 to 5% by weight, based on the end products.

Partly alkoxylated compounds prepared in a conventional manner, ie. by catalysis with alkali metal hydroxides, can also be used as starting compounds. All that is important is that the required polydispersity is obtained by subsequent alkoxylation using, according to the invention, the abovementioned metal alcoholates.

The polydispersity Q must be at least 1.7 in order for the desired effect to be achieved. Q is preferably 1.7–5, particularly preferably 1.8–3.0, in particular 1.8–2.8. It should be noted that the differences in the values between alkoxylates prepared using conventional catalysts and alkoxylates prepared with the catalysts to be used according to the invention vary depending on the compound R–H which is used as starting material. However, the difference between these Q values should be 0.3 or more, based on the same starting compound R–H.

The $\overline{M}_w$ and $\overline{M}_n$ values required for calculating Q were determined by gel permeation chromatography.

The specific conditions in the GPC analysis were as follows:

Column material: PL gel with 5 μm particle size

Column length: 300 cm, diameter 7.5 mm.

A column combination comprising a precolumn, a column containing 100 Å material, 2 columns containing 500 Å material and a further column containing 1000 Å material was used. Toluene acted as an internal standard and the flow rate was 1 ml/min and the temperature 70° C.

Detector: RI+UV (254 nm).

The volume applied was 20 μl of a 1% strength by weight solution and the solvent was THF.

$\overline{M}_n$ and $\overline{M}_w$ values were determined from the chromatogram with the aid of calibration substances (ethoxylates), by means of a conventional computer program.

In addition to the alkoxylate A of the general formula I, the novel oil demulsifiers may contain, as a further component B, a different oxyalkylated polyalkylenepolyamine which does not have the novel values of Q. Such additional components are known and are described in, for example, German Patent 2,719,978, and reference is therefore :made in this patent in particular to column 4, B. This additional component of the mixture is also disclosed in German Laid-Open Application DOS 2,227,546.

The weight ratio of A to B is preferably from 60:40 to 40:60.

The demulsifiers are advantageously added to the crude oil emulsions in amounts of from 1 to 1,000 ppm, preferably from 10 to 100 ppm, based on the weight of the emulsion to be demulsified, at from 20° to 80° C.

The demulsifiers can be used as solutions, owing to their better meterability in that form. The solvents used may be mixtures of organic solvents (eg. methanol) with water or organic solvents alone, having boiling limits of from 50° to 200° C., for example toluene, xylenes, tetrahydrofuran, dioxane, lower alcohols and light gasolene fractions having the stated boiling limit.

When solutions are used, they are advantageously brought to an active ingredient content (content of demulsifiers) of from 0.5 to 50% by weight. During demulsification, the solutions are preferably added to the crude oils at the wells (in the field). Demulsification then takes place at the temperature of the freshly extracted water-in-oil emulsion at a rate such that the emulsion can be broken on the way to the processing plant. There, it is separated into pure oil and salt water without difficulties in an unheated or heated separator and possibly with the aid of an electric field.

EXAMPLES

A) Preparation Examples for alkoxylates

1. The starting compounds shown in Table 1 were reacted with a number of moles, also indicated, of alkylene oxide using the particular catalyst in toluene at the stated temperatures. The polydispersities Q obtained are likewise shown in Table 1.

TABLE 1

| Alkoxylate | Starting material | Moles of alkylene oxide | Catalyst | Q | T in °C. |
|---|---|---|---|---|---|
| A1 | NPFH | 4.1 EO | ATIP | 2.4 | 120–130 |
| A2 | EONP | 5.0 PO | ATIP | 1.9 | 130–140 |
| A3 | NPFH | 9.7 PO | ATIP | 2.4 | 130–140 |
| A4 | NPFH | 4.9 EO | ATIP | 2.7 | 120–130 |
| A5 | DPFH | 9.3 EO | ATIP | 2.5 | 120–130 |
| A6 | DPFH | 7.8 PO | ATIP | 2.1 | 130–140 |
| A7 | DPFH | 6.8 EO | ATIP | 2.0 | 120–130 |

COMPARATIVE EXAMPLES

| Alkoxylate | Starting Material | Moles of alkylene oxide | Catalyst | Q |
|---|---|---|---|---|
| a1 | NPFH | 4.1 EO | KOH | 1.5 |
| a2 | EONP | 4.9 PO | KOH | 1.6 |
| a3 | NPFH | 5.6 EO + 1.8 PO | KOH | 1.4 |
| a4 | NPFH | 15.1 EO + 15.0 PO | KOH | 1.5 |
| a5 | NPFH | 9.8 PO | KOH | 1.5 |

Abbreviations:
NPFH: Isononylphenol/formaldehyde resin
EONP: Isononylphenol/formaldehyde resin alkoxylated with 4.1 mol of EO under KOH catalysis
DPFH: Isododecylphenol/formaldehyde resin
EO: Ethylene oxide
PO: Propylene oxide
ATIP: Aluminum triisopropylate 2. According to the prior art (cf. German Patent 2,719,978), about 500 g of propylene oxide (PO) were forced with nitrogen at from 90° to 100° C. in the course of 600 minutes at 6.5 bar into a 2 l stirred autoclave containing 782 g (0.0191 mol) of a polyethyleneimine having a molecular weight of about 18,000 (44% strength solution in $H_2O$).

The water was then removed under reduced pressure. 852 g of product were obtained, ie. the actual uptake of PO was 1.1 mol per ethyleneimine unit in the polyethyleneimine.

In a second stage, 667 g of propylene oxide were forced at from 130° to 140° C. in the course of 36 hours at 7.4 bar into the stirred autoclave containing 53.4 g of product from stage 1, in the presence of 0.53 g (1% by weight) of potassium tert-butylate. The excess propylene oxide (PO) was then removed. 715 g of product were obtained, ie. 22.8 mol of PO were taken up per ethyleneimine unit in the polyethyleneimine.

Finally, in a third stage, 132 g of ethylene oxide (EO) were forced at from 120° to 130° C. in the course of 150 minutes at 6.8 bar onto 214.4 g of the product from stage 2, in the presence of 2.14 g of potassium tert-butylate, and the excess EO was removed. 361 g of product were obtained, ie. the actual uptake of EO was 21.9 mol per ethyleneimine unit in the polymer.

The end product had a Q value of 1.4.

3. In the preparation of the novel alkoxylate, stages 1 and 2 were first carried out as stated under 2. and the potassium tert-butylate was then separated off.

132 g of EO were then forced with nitrogen at from 120° to 130° C. in the course of 870 minutes at 9.4 bar into a stirred autoclave containing 214.4 g of the resulting product, in the presence of 6.43 g of aluminum triisopropylate (≙3% by weight), and excess EO was then removed. 365 g of product were obtained, ie. the actual uptake of EO was 21.8 mol per ethyleneimine unit in the polyethyleneimine.

This product had a Q value of 1.7.

B) Use Examples

The alkoxylates obtained according to A) 1. were mixed with an oxyalkylated polyalkylenepolyamine B, prepared according to German Patent 2,719,978, column 4, B, in a ratio of 1:1, and were tested to determine their efficiency as oil demulsifiers.

The amounts of the corresponding alkoxylates stated in each case were added to 100 g of one of the crude oil emulsions shown in Table 2. The mixtures were each stirred in a glass flask with a mechanical stirrer at 55° C. for 10 minutes at a stirring speed of 500 rpm and were poured into a 100 ml cylinder. The cylinder was placed in a water bath at the stated test temperature, and the separation of water was observed and recorded in the course of 4 hours.

TABLE 2

| Alkoxylate | Dose ppm | Crude oil emulsion | Test temperature °C. | Result cf. Table 3 |
|---|---|---|---|---|
| A1 | 25 | North German oil I | 55 | 1 |
| a1 | 25 | North German oil I | 55 | 2 |
| A1 | 100 | North German oil II | 50 | 3 |
| a1 | 100 | North German oil II | 50 | 4 |
| A2 | 50 | Middle East oil | 70 | 5 |
| a2 | 50 | Middle East oil | 70 | 6 |
| A2 | 120 | North German oil II | 50 | 7 |
| a2 | 120 | North German oil II | 50 | 8 |
| A2 | 25 | North Ger- | 55 | 9 |

TABLE 2-continued

| Alkoxylate | Dose ppm | Crude oil emulsion | Test temperature °C. | Result cf. Table 3 |
|---|---|---|---|---|
| | | man oil I | | |
| a2 | 25 | North German oil I | 55 | 10 |
| A2 | 100 | North German oil III | 27 | 11 |
| a2 | 100 | North German oil III | 27 | 12 |

In the test below, the alkoxylates were tested without the additional component B, under otherwise identical conditions as stated for Table 2:

| | | | | |
|---|---|---|---|---|
| A2 | 120 | North German oil II | 50 | 13 |
| a2 | 120 | North German oil II | 50 | 14 |

The results are shown in Table 3.

TABLE 3

| No. from Table | Formation water (ml) separated from 100 g of emulsion after: | | | | | | | |
|---|---|---|---|---|---|---|---|---|
| | Minutes | | | | | Hours | | |
| 2 | 10 | 20 | 30 | 45 | 60 | 2 | 4 | 16 |
| 1 | 0 | 0 | 3 | 5 | 8 | 20 | 25 | |
| 2 | 0 | 0 | 1 | 3 | 5 | 18 | 22 | |
| 3 | 0 | 0 | 4 | 24 | 28 | 35 | 39 | |
| 4 | 0 | 0 | 4 | 9 | 15 | 31 | 33 | |
| 5 | 0 | 0 | 1 | 3 | 9 | 17 | 20 | |
| 6 | 0 | 0 | 0 | 0 | 0 | 2 | 4 | |
| 7 | 0 | 0 | 2 | 7 | 13 | 21 | 30 | |
| 8 | 0 | 0 | 0 | 0 | 4 | 12 | 19 | |
| 9 | 0 | 1 | 2 | 8 | 15 | 17 | 23 | |
| 10 | 0 | 0 | 0 | 2 | 2 | 9 | 15 | |
| 11 | 0 | 0 | 2 | 8 | 12 | 17 | 19 | |
| 12 | 0 | 0 | 0 | 4 | 7 | 10 | 13 | |
| 13 | 0 | 0 | 0 | 0 | 3 | 10 | 16 | 24 |
| 14 | 0 | 0 | 0 | 0 | 0 | 1 | 3 | 7 |

The Examples with the even numbers are each Comparative Examples.

The results show that the novel oil demulsifiers result in substantial improvements in the rate of demulsification for a large number of different crude oil emulsions.

We claim:

1. An oil demulsifier based on an alkoxylate of the formula I $$R[(A-O)_n H]_p \qquad \text{I}$$

where A is ethylene, propylene or butylene, n is 3–100 and R is the radical of an alkylphenol/formaldehyde resin of the formula II

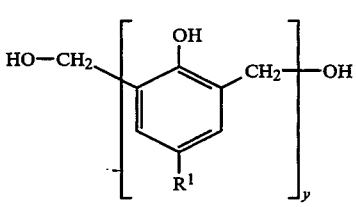

II where $R^1$ is branched $C_3$–$C_{18}$-alkyl and y is from 3 to 30, of an alcohol of the formula III $$(R^3O)_z R^2 (OH)_x \qquad \text{III}$$

where either $R^2$ is $C_1$–$C_{20}$-alkyl, x is 1 and z is 0 or $R^2$ is $C_2$–$C_{10}$-alkylene, x is 2 and z is 0 or x is 1, z is 1 and $R^3$ is $C_1$–$C_6$-alkyl or $C_1$–$C_{20}$-acyl, or $R^2$ is $C_6$–$C_{10}$-aryl which may be substituted by up to 2 $C_3$–$C_{18}$-alkyl radicals, x is 1 and z is 0, of an amine of the formula IV $$R^4-NH_2 \qquad \text{IV}$$

where $R^4$ is a straight-chain or branched $C_1$–$C_6$-alkyl or $C_1$–$C_{10}$-hydroxyalkyl radical or is a radical of the following formula V $$(CH_2)_m N_q (CH_2)_r-NH_2 \quad (R^5) \qquad \text{V}$$

where $R^5$ is H or $C_1$–$C_3$-alkyl, m is from 2 to 4, r is from 2 to 10 and q is from 0 to 5, of a bisphenol of the formula VI

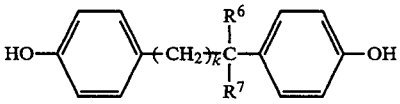

VI where k may be from 0 to 3 and $R^6$ and $R^7$ independently of one another may each be H or $C_1$–$C_3$-alkyl, or of a polyethyleneimine having a molecular weight $\overline{M}_w$ of from 2,000 to 50,000, where the $[H-(O-A)_n]$ radicals are each present in place of those hydrogens of the alkylphenol/formaldehyde resins, alcohols, bisphenols, amines or polyethyleneimines which are on the oxygen or nitrogen and p is the number of hydrogens to be alkoxylated, wherein the alkoxylate of the formula I has a polydispersity $Q=\overline{M}_w/\overline{M}_n$ of at least 1.7, said alkoxylate of the formula I having been formed by the reaction of ethylene oxide, propylene oxide or butylene oxide with an alkylphenol/formaldehyde resin of the formula II, a bisphenol of the formula VI, an alcohol of the formula III, an amine of the formula IV or a polyethyleneimine having a molecular weight of $\overline{M}_w$ of from 2,000 to 50,000 in the presence of an unhydrolyzed or partly hydrolyzed metal alcoholate as a catalyst, the metal being selected from the group consisting of the metals Be, Mg, Ca, Sr, Ba, Ra, B, Al, Ga, In, Tl, Ti, Zr, Hf, Zn, Ce and La and the alcoholate group being of 1 to 8 carbon atoms.

2. An oil demulsifier as claimed in claim 1, wherein R is a radical of an alkylphenol/formaldehyde resin of the formula II, where $R^1$ is iso-$C_4$–$C_{12}$-alkyl, y is from 5 to 11 and n is from 3 to 50.

3. An oil demulsifier as claimed in claim 1, wherein R is an alcohol of the formula III, where x is 2 and z is 0 or x is 1, z is 1 and $R^3$ is $C_1$–$C_3$-acyl.

4. An oil demulsifier as claimed in claim 1, wherein Q is from 1.7 to 5.0.

5. An oil demulsifier as claimed in claim 1, which, in addition to the alkoxylate of the formula I, contains a different oxyalkylated polyalkylenepolyamine.

6. An oil demulsifier as claimed in claim 1, wherein A is an ethylene or propylene radical.

7. An oil demulsifier as claimed in claim 1, wherein R is a radical of an alkylphenol/formaldehyde resin of the formula II, where $R^1$ is iso-$C_4$-$C_{12}$-alkyl, y is from 5 to 11 and n is from 4 to 12.

8. An oil demulsifier as claimed in claim 1, wherein Q is from 1.8 to 3.0.

9. A process for the preparation of alkoxylates of the formula I $$R[(A-O)_n H]_p \qquad \text{I}$$

where A is ethylene, propylene or butylene, n is 3–100 and R is the radical of an alkylphenol/formaldehyde resin of the formula II

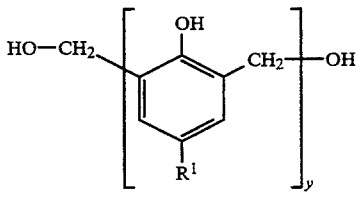

II where $R^1$ is branched $C_3$–$C_{18}$-alkyl and y is from 3 to 30, of an alcohol of the formula III $$(R^3O)_z R^2 (OH)_x \qquad \text{III}$$

where either $R^2$ is $C_1$–$C_{20}$-alkyl, x is 1 and z is 0 or $R^2$ is $C_2$–$C_{10}$-alkylene, x is 2 and z is 0 or x is 1, z is 1 and $R^3$ is $C_1$–$C_6$-alkyl or $C_1$–$C_{20}$-acyl, or $R^2$ is $C_6$-$C_{10}$-aryl which may be substituted by up to 2 $C_3$–$C_{18}$-alkyl radicals, x is 1 and z is 0, of an amine of the formula IV $$R^4-NH_2 \qquad \text{IV/3}$$

where $R^4$ is a straight-chain or branched $C_1$–$C_6$-alkyl or $C_1$–$C_{10}$-hydroxyalkyl radical or is a radical of the following formula V $$[(CH_2)_m \underset{\underset{R^5}{|}}{N}]_q (CH_2)_r - NH_2 \qquad \text{V}$$

where $R^5$ is H or $C_1$–$C_3$-alkyl, m is from 2 to 4, r is from 2 to 10 and q is from 0 to 5, of a bisphenol of the formula VI

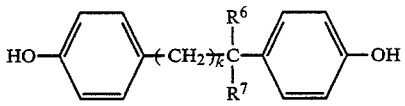

VI where k may be from 0 to 3 and $R^6$ and $R^7$ independently of one another may each be H or $C_1$–$C_3$-alkyl, or of a polyethyleneimine having a molecular weight $\overline{M}_w$ of from 2,000 to 50,000, where the $[H-(O-A)_n]$ are each present in place of those hydrogens of the alkylphenol/formaldehyde resins, alcohols, bisphenols, amines of polyethyleneimines which are on the oxygen or nitrogen and p is the number of hydrogens to be alkoxylated, wherein the alkoxylate of the formula I has a polydispersity $Q=\overline{M}_w/\overline{M}_n$ of at least 1.7 which process comprises: reacting an alkylphenol/formaldehyde resin of the formula II, a bisphenol of the formula VI, an alcohol of the formula III, an amine of the formula IV or a polyethyleneimine having a molecular weight $\overline{M}_w$ of from 2,000 to 50,000 with ethylene oxide, propylene oxide or butylene oxide in the presence of an unhydrolyzed or partly hydrolyzed metal alcoholate as a catalyst, the metal being selected from the group consisting of the metals Be, Mg, Ca, Sr, Ba, Ra, B, Al, Ga, In, Tl, Ti, Zr, Hf, Zn, Ce and La and the alcoholate group being of 1 to 8 carbon atoms.

10. A process as claimed in claim 9, wherein the metal is Al or Ti and the alcoholate group is a $C_2$-, n- or iso-$C_3$-, n- or iso-$C_4$- or tert-$C_4$- group.

* * * * *